US005285970A

United States Patent [19]

Maier et al.

[11] Patent Number: 5,285,970

[45] Date of Patent: Feb. 15, 1994

[54] METHOD FOR CALIBRATING A FUEL INJECTION VALVE, AND FUEL INJECTION VALVE

[75] Inventors: Martin Maier, Moeglingen; Juergen Buchholz, Lauffen, both of Fed. Rep. of Germany

[73] Assignee: Robert Bosch GmbH, Stuttgart, Fed. Rep. of Germany

[21] Appl. No.: 847,099

[22] PCT Filed: Jul. 17, 1991

[86] PCT No.: PCT/DE91/00587

§ 371 Date: Apr. 15, 1992

§ 102(e) Date: Apr. 15, 1992

[87] PCT Pub. No.: WO92/03652

PCT Pub. Date: Mar. 5, 1992

[30] Foreign Application Priority Data

Aug. 16, 1990 [DE] Fed. Rep. of Germany ..... 4025945

[51] Int. Cl.[5] ..... F02M 61/16; B05B 1/16

[52] U.S. Cl. ..... 239/533.12; 239/585.4; 239/596; 239/600

[58] Field of Search ..... 239/455, 590.3, 590, 239/533.3, 533.12, 599, 496, 600; 231/585.1-585.5

[56] References Cited

U.S. PATENT DOCUMENTS 1,947,407 2/1934 Cornell ..... 239/451
4,040,396 8/1977 Tomita ..... 239/533.12 X
4,907,748 3/1990 Gardner et al. ..... 239/590.3 X
4,923,169 5/1990 Grieb et al. ..... 239/585.1 X

FOREIGN PATENT DOCUMENTS 148190 6/1951 Sweden ..... 239/590.3
667463 3/1952 United Kingdom ..... 239/533.12

*Primary Examiner*—David M. Mitchell
*Assistant Examiner*—Kevin P. Weldon
*Attorney, Agent, or Firm*—Edwin E. Greigg; Ronald E. Greigg

[57] ABSTRACT

In known fuel injection valves, a perforated disk having metering openings is disposed downstream of the valve seat. Adjusting the static fuel quantity injected during the steady opening state of the fuel injection valve is accomplished by means of the precise manufacture of the metering openings. Despite the high expense and effort of manufacture, an undesirably high deviation in the static fuel quantity of the various fuel injection valves occurs in mass production. The static fuel quantity is adjusted directly at the completely assembled fuel injection valve, so that the deviation of the static fuel quantity of the various fuel injection valves is minimized. To this end, the valve housing and the perforated disk are moved relative to one another, and as a result the various free flow cross sections of the metering openings are varied until the injected fuel quantity flow match the required fuel quantity flow. The method according to the invention is suitable for fuel injection valves of various types.

15 Claims, 5 Drawing Sheets

METHOD FOR CALIBRATING A FUEL INJECTION VALVE, AND FUEL INJECTION VALVE

BACKGROUND OF THE INVENTION

The invention is based on a method for adjusting the static fuel quantity injected during the steady opening state of a fuel injection valve, as generically defined hereinafter, as well as to a fuel injection valve, as disclosed herein and known from German Patent Disclosure Document DE-OS 37 10 467. The fuel injection valve known from DE-OS 37 10 467 has a perforated disk downstream of its valve seat. The adjustment of the static fuel quantity is effected by the accurate manufacture of the metering openings embodied in the perforated disk. Despite the high production investment, the deviation in the static fuel quantity of individual mass-produced fuel injection valves is undesirably pronounced. This creates the danger that a variably high fuel quantity will be delivered to the various cylinders of an internal combustion engine.

OBJECT AND SUMMARY OF THE INVENTION

The method according to the invention for adjusting the static fuel quantity produced during the steady opening state of a fuel injection valve, and the fuel injection valve have the advantage over the prior art that the static fuel quantity is adjustable in a simple manner, in the otherwise completely assembled fuel injection valve, by varying the free flow cross sections of the metering openings. This makes it possible to assure that the mass-produced fuel injection valves exhibit especially slight deviation in the static fuel quantity, and that the same fuel quantity will be metered to the various cylinders of an internal combustion engine, for instance.

An improvement in fuel atomization is moreover attained by the partial coverage of the metering openings.

Further advantageous features of and improvements to the method revealed as well as the fuel injection valve are possible with the provisions recited in the dependent claims.

Advantageously, the perforated disk in the valve housing can be rotated relative to one another in order to adjust the static fuel quantity.

For the especially simple, economical embodiment of a fuel injection valve serving to carry out the method of the invention, it is advantageous if the flow opening, provided immediately upstream of the perforated disk, of the flow conduit of the fuel injection valve has a cross section that deviates from the circular shape, preferably being in the form of an oblong slot or a rosette.

For the same reason, it is also advantageous if an intermediate disk is provided axially immediately upstream of the perforated disk, that is, between the face end of the nozzle body and the perforated disk, the intermediate disk being supported in a manner fixed against rotation and firmly joined to the nozzle body, with its at least one through opening communicating with both the flow opening of the flow conduit and the metering openings of the perforated disk.

It is especially advantageous if the intermediate disk has the same number of through openings as the perforated disk has metering openings, and if the metering openings of the perforated disk and the through openings of the intermediate disk have the same diameter and are embodied on the same hole circle diameter.

It is especially advantageous if the perforated disk and the intermediate disk are manufactured as identical parts, which has advantages not only in terms of simple and more economical manufacture but also assembly. This embodiment of the perforated disk and intermediate disk is especially practical if the perforated disk and the intermediate disk are rotatable relative to one another for adjusting the static fuel quantity by the method of the invention.

For the sake of embodying the metering openings of the perforated disk and the through openings of the intermediate disk with especially sharp edges, it is advantageous if the perforated disk and/or the intermediate disk are made of monocrystalline silicon, resulting in especially good fuel atomization.

DRAWING

Exemplary embodiments of the invention are shown in simplified form in the drawing and described in further detail in the ensuing description.

DESCRIPTION OF THE EXEMPLARY EMBODIMENTS

Figure 1:
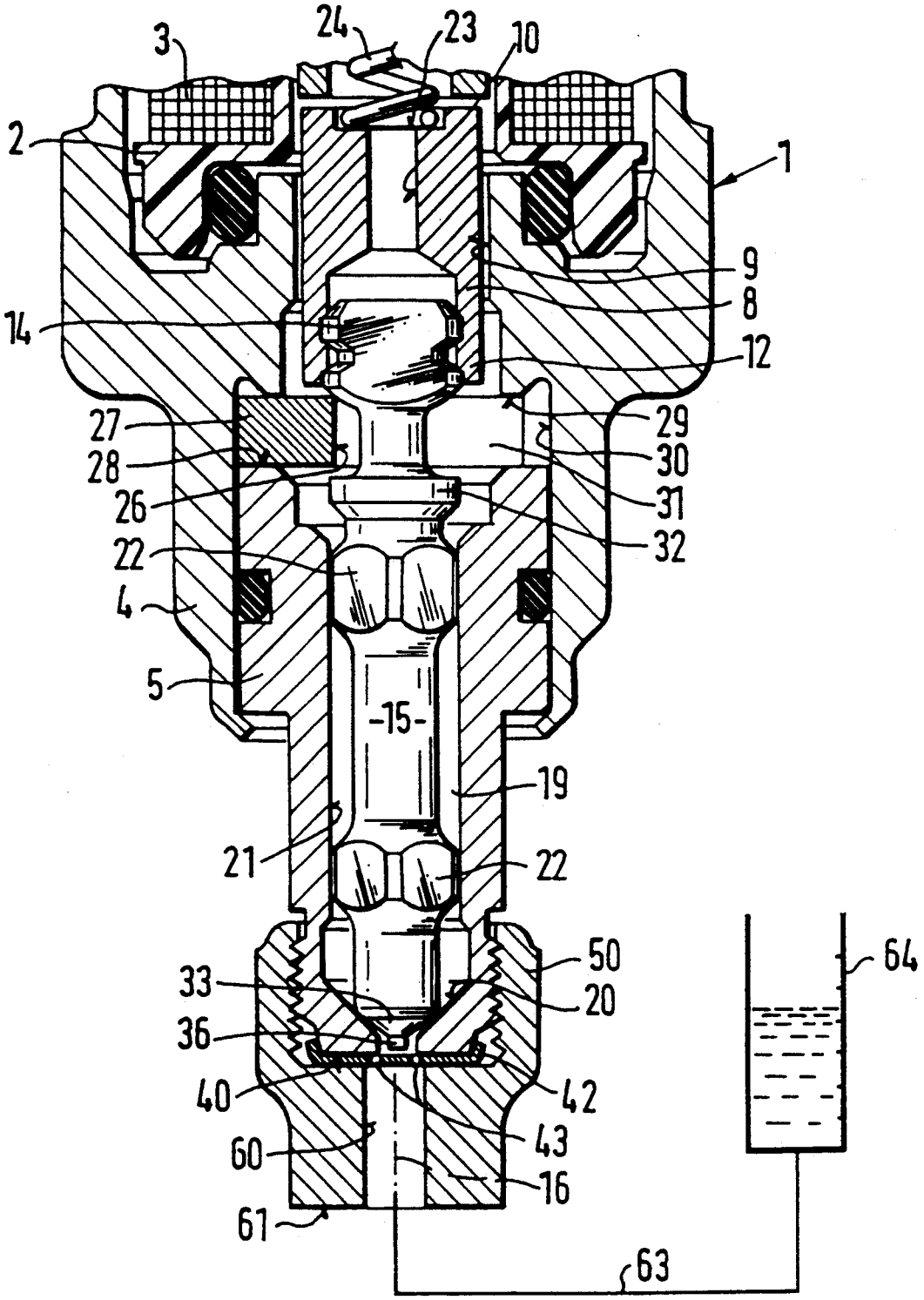
FIG. 1 is a fragmentary view of a fuel injection valve serving to carry out the method of the invention.

In FIG. 1, an electromagnetically actuatable fuel injection valve, for example, for fuel injection systems of mixture-compressing internal combustion engines with externally supplied ignition, for example, is shown in which the static fuel quantity can be adjusted by the method of the invention.

The fuel injection valve has a tubular, for instance stepped valve housing 1 made of a ferromagnetic material, in which a magnet coil 3 is disposed on a coil body 2. By its lower housing end 4, the valve housing 1 axially partially surrounds a nozzle body 5. A cylindrical, hollow armature 8 cooperates with the magnet coil 3 and protrudes through a magnetic line conducting shoulder 9 of the valve housing 1 in the axial direction. The armature 8 has a stepped longitudinal bore 10. The armature 8, by a region 12 remote from the magnet coil 3, peripherally engages a retainer part 14 of a valve needle 15 and is firmly joined to the valve needle 15.

The nozzle body 5 has a stepped, continuous flow conduit 19 that is concentric with a longitudinal valve axis 16. On its end remote from the valve housing 1, a conical valve seat face 20 is formed in the flow conduit 19, as shown by the highly enlarged detail of the fuel injection valve in FIG. 2. Two guide segments 22, for instance embodied as squares, of the valve needle 15, are guided by the guide region 21 of the flow conduit 19, but also leave an axial passageway free for the fuel.

A compression spring 24 rests by one end on a bearing shoulder 23 of the longitudinal bore 10 of the armature 8, toward the magnet coil 3. By its other end, the compression spring 24 is supported on a fixed adjusting bush, not shown. The compression spring 24 urges the armature 8 and the valve needle 15 joined to it in the direction of the valve seat face 20.

With radial spacing, the valve needle 15 penetrates a through opening 26 in a stop plate 27, which is disposed between a face end 28 of the nozzle body 5 toward the armature 8 and a retaining shoulder 29 embodied in a flow bore 30 of the valve housing 1. In the stop plate 27, a recess 31, the inside diameter of which is larger than the diameter of the valve needle 15, is provided, leading from the through opening 26 to the periphery of the stop plate 27.

Axially between the retaining part 14 and the guide segment 22 toward the retaining part 14, the valve needle 15 has a stop flange 32. The stop flange 32 of the valve needle 15 cooperates with the stop plate 27 in such a way that the opening stroke of the valve needle 15 is limited. Remote from the retaining part 14, the valve needle 15 has a conical segment 33, acting as a valve closing part, which cooperates with the conical valve seat face 2 of the nozzle body 5 and effects the opening and closing of the fuel injection valve. A tang 36 of the valve needle 15 adjoins the conical segment 33 in the flow direction.

Adjoining the conical valve seat face 20 in the direction remote from the armature 8, the flow conduit 19 continues within a flow segment 35, and it ends in a flow opening 39 at one face end 40 of the nozzle body 5.

Instead of the circular cross section shown, the flow segment 35 may also have some other cross section, for instance oval, rectangular, or other.

A perforated disk 42 which is embodied as flat is disposed at the face end 40 of the nozzle body 5. The perforated disk 42 has at least two and for example four circular metering openings 43, which communicate with the flow opening 39 of the flow conduit 19 and whose longitudinal axis 44 have the same orientation as the longitudinal valve axis 16 or are inclined relative to it. All the metering openings 3 have the same diameter, by way of example, but it is also possible for the various metering openings 43 to have a variably large diameter, or to have a shape departing from the circular, for instance with an oval or rectangular or similar cross section. All four metering openings 43 are embodied on the same hole circle diameter 45, by way of example.

The fastening of the perforated disk 42 to the face end 40 of the nozzle body 5 is assured by a preparation sleeve 50. In an outer region, the perforated disk 42 rests with a second face 54 remote from the valve seat face 20 on a bottom 52 of a coaxial blind bore 53 of the preparation sleeve 50, and it is pressed by its first face 51, toward the valve seat face 20, against the face end 40 of the nozzle body 5. A rim 56 of the perforated disk 42, for instance formed by deep drawing, peripherally engages part of a conical region 57 of the nozzle body 5, so that the perforated disk 42, clamped between the bottom 52 of the preparation sleeve 50 and the face end 40 of the nozzle body 5, has no radial play and as a result is centered relative to the nozzle body 5.

The clamping of the perforated disk 42 between the nozzle body 5 and the preparation sleeve 50 is achieved for instance by screwing the preparation sleeve 50, with an internal thread 58, onto an external thread 58 embodied on the circumference of the nozzle body 5. A preparation bore 60 extends concentrically with the longitudinal valve axis 16 in the bottom 52 of the preparation sleeve 50 and extends as far as the face end 61 of the preparation sleeve 509 remote from the internal thread 58. The fuel is injected through the metering openings 43 into the preparation bore 60 of the preparation sleeve 50.

However, it is also possible to fasten the perforated disk 42 directly to the face end 40 of the nozzle body 5, for instance by welding.

Figure 2:
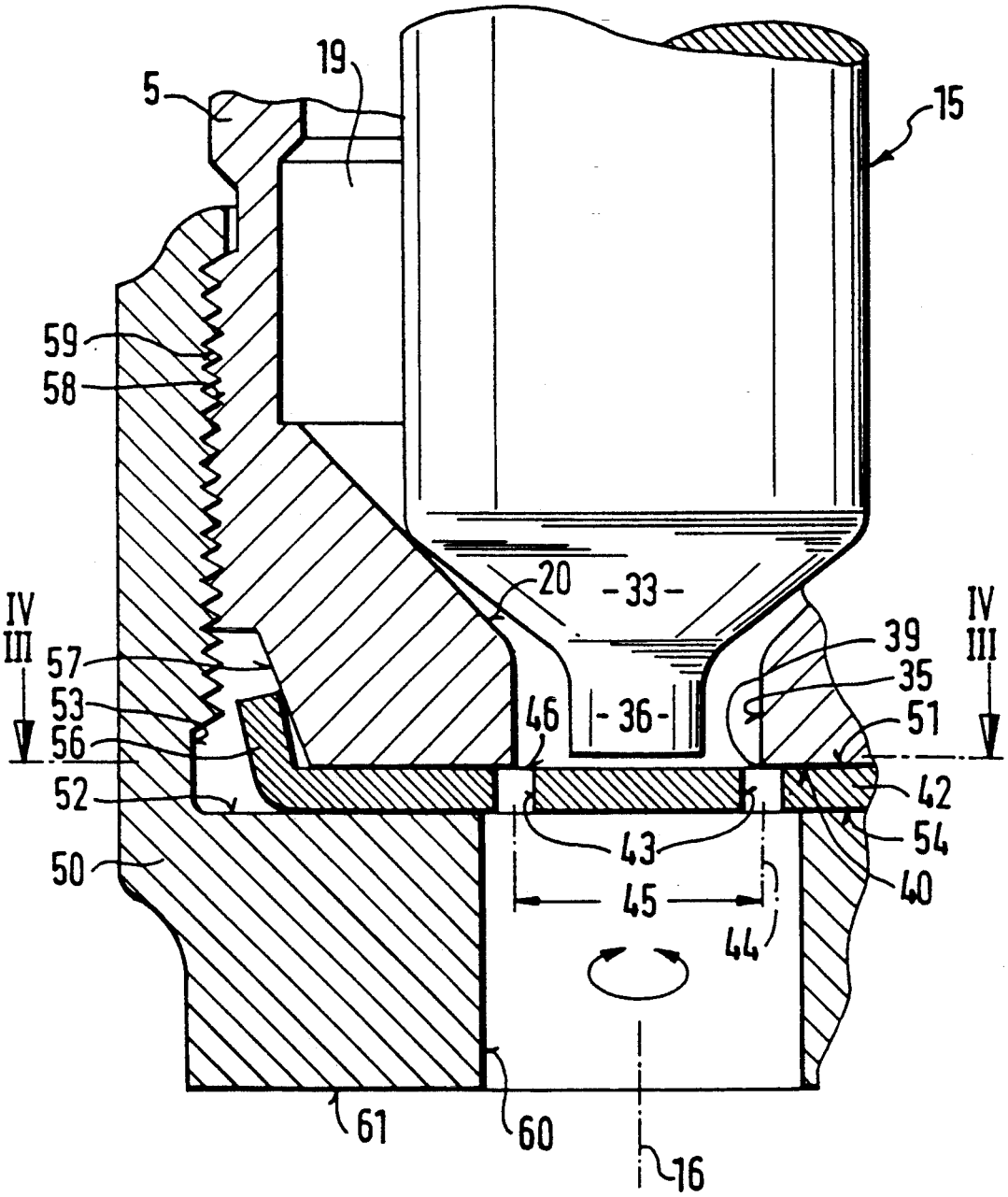
FIG. 2 is a highly enlarged detail of FIG. 1.
Figure 3:
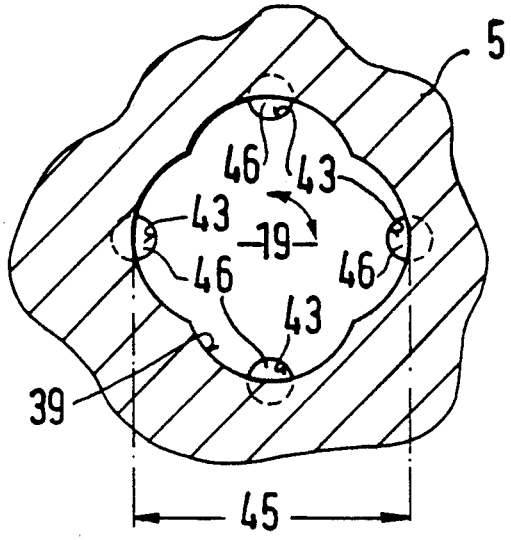
FIG. 3 is a section through the fuel injection valve in accordance with a first exemplary embodiment, taken along the line III—III of FIG. 2.

FIG. 3 shows a section through a first exemplary embodiment of a fuel injection valve, serving to carry out the method of the invention, taken along the line III—III of FIG. 2. The flow opening 39 of the flow conduit 19 of the nozzle body 5, in the first exemplary embodiment, has a rosette-like cross section which deviates from the circular cross-sectional shape. The hole circle diameter 45, on which the metering openings 43 of the perforated disk 42 are disposed, is selected such that the metering openings 43 are partially covered by the face end 40 of the nozzle body 5; as a result, the various metering openings 43 are only partially covered by the rosette-shaped cross section of the flow opening 39 of the flow conduit 19, and a free flow cross section 46 is formed at each of the metering openings 43 as a result of this coverage. The portion of the cross section of the metering opening 43 covered by the face end 40 of the nozzle body 5 is shown in dashed lines in FIG. 3.

After the assembly of the fuel injection valve, in a first method step of the method of invention for adjusting the static fuel quantity injected during the steady opening state, the quantity of fuel output per unit of time from the opened fuel injection valve is measured, for instance by means of a measuring container 64 communicating with the preparation bore 60 via a fuel line 63. If the actual quantity output does not match the desired, specified set-point quantity of the fuel, then in a second method step according to the invention, the fuel injection valve or the valve housing 1 and the perforated disk 42 are moved relative to one another, thereby varying the free flow cross sections 46 of the various metering openings 43. If the actual quantity output matches the specified set-point quantity, then the perforated disk 42, in a third method step of the invention, is fixed to the nozzle body 4 or to the valve housing 1, for instance by means of the preparation sleeve 50.

A particularly simple method for adjusting the static fuel quantity, which for example can be employed for the first exemplary embodiment shown, comprises rotating the fuel injection valve or valve housing 1 and the perforated disk 42 relative to one another to vary the free flow cross sections 46 of the various metering openings 43. The coaxial position of the perforated disk 42 between the bottom 52 of the preparation sleeve 50 and the face end 40 of the nozzle body 5 continues to be assured as a result.

Figure 4:
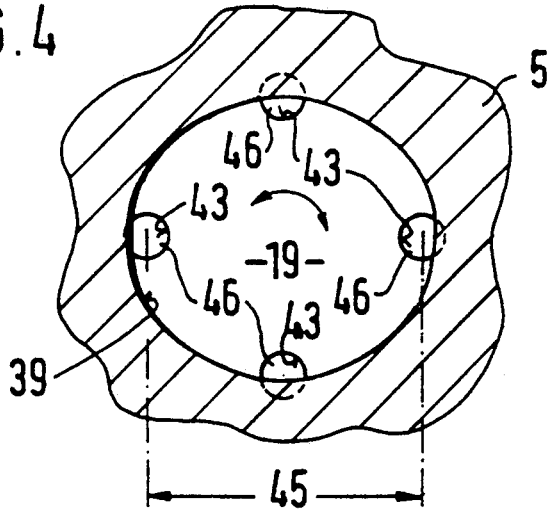
FIG. 4 is a section through the fuel injection valve in accordance with a second exemplary embodiment, taken along the line IV—IV of FIG. 2.

FIG. 4 shows a section through a fuel injection valve, serving to carry out the method of the invention, according to a second exemplary embodiment, taken along the line IV—IV of FIG. 2. Elements that are the same and function the same are identified by substantially the same reference numerals as in FIGS. 1-3. The flow opening 39 of the flow conduit 19 of the nozzle body 5 has a cross section in the form of an oblong slot, departing from the circular cross-sectional shape. The perforated disk 42, clamped and centered between the bottom 52 of the preparation sleeve 50 and the face end 40 of the nozzle body 5, has by way of example four circular metering openings 3, all of them with the same diameter. However, the metering openings 43 may also have some different cross-sectional shape and different cross sections.

The hole circle diameter 45 on which the four metering openings 43 are for instance disposed, is selected such that the various metering openings 43 are partially covered by the oblong-slot-like flow openings 39 of the flow conduit 19. The portion of the cross section of each metering opening 43 that is covered by the face end 40 of the nozzle body 5 is shown in dashed lines in FIG. 4.

In a first method step, first the fuel quantity output per unit of time during the steady opening state of the completely assembled, opened fuel injection valve is measured. If the actual quantity of fuel output does not match the specified set-point quantity, then in a second method step of the invention, the fuel injection valve or valve housing 1 and the perforated disk 42 are rotated relative to one another, for example, and the free flow cross sections 46 of the various metering openings 43 are varied thereby. If the actual quantity output matches the specified set-point quantity, then the perforated disk 42, in a third method step according to the invention, is fixed to the nozzle body 4 or valve housing 1, for instance by means of the preparation sleeve 50.

Figure 5:
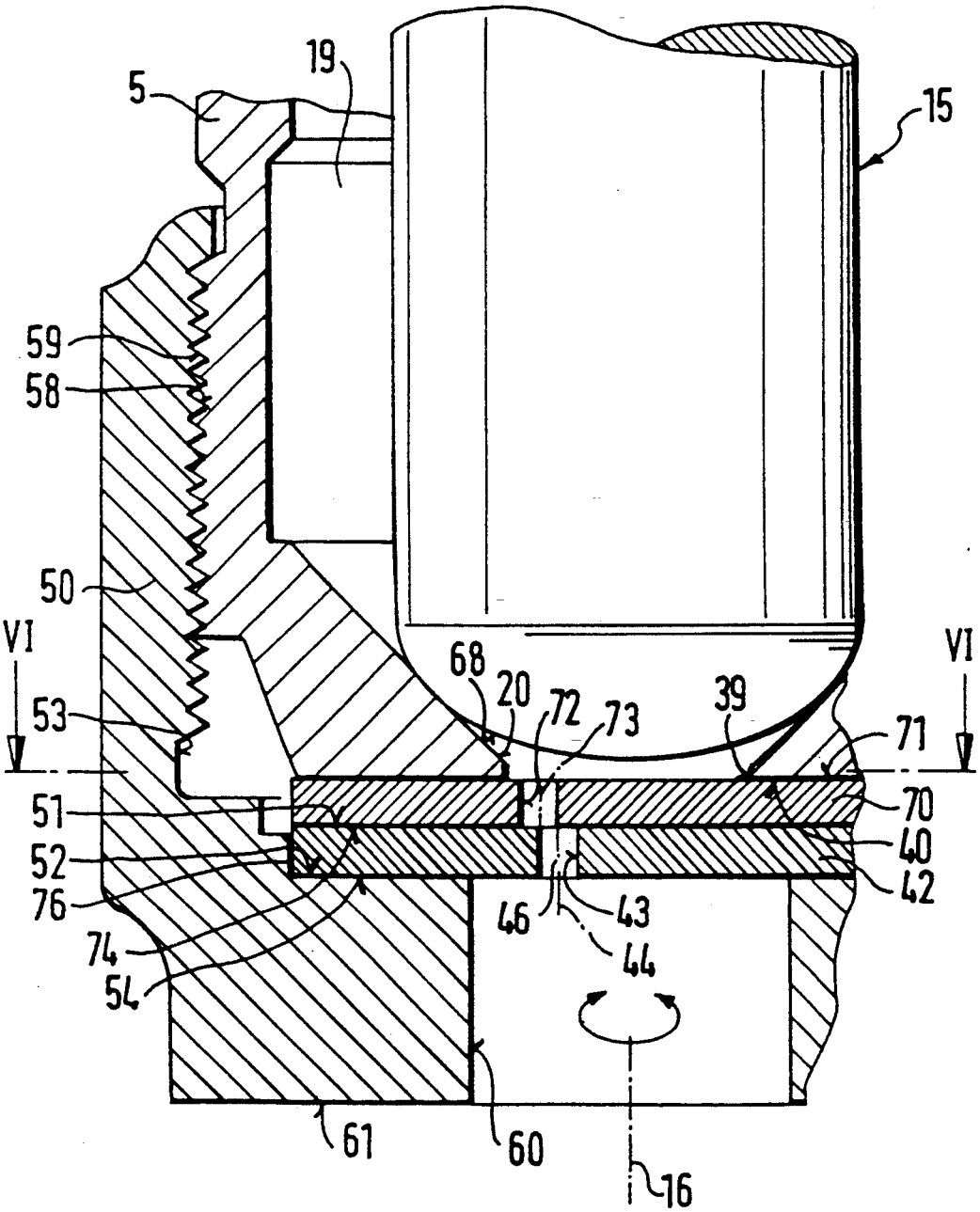
FIG. 5 is a fragmentary view of a third exemplary embodiment of a fuel injection valve for carrying out the method of the invention.
Figure 6:
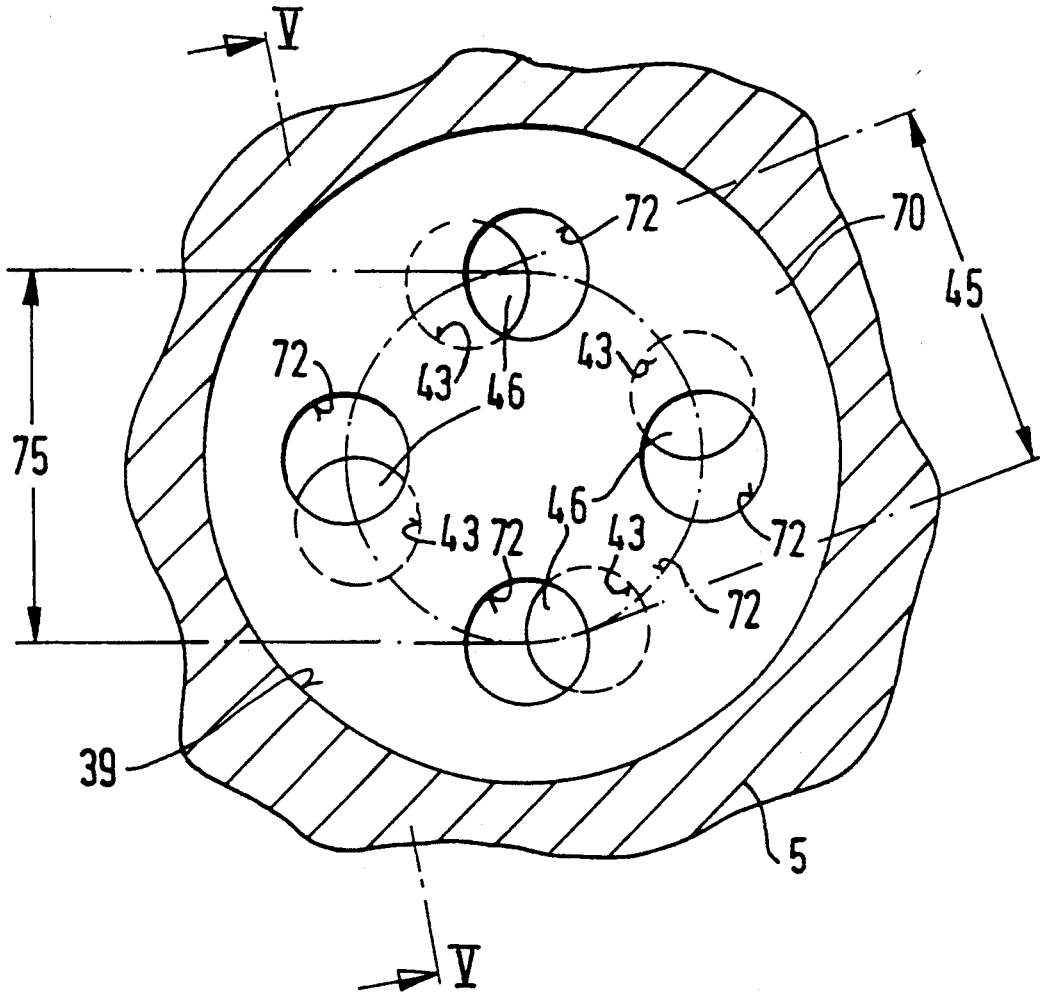
FIG. 6 is a section taken along the line VI—VI of FIG. 5.

FIGS. 5 and 6 show a third exemplary embodiment of a fuel injection valve, shown in fragmentary form and serving to carry out the method of the invention. Elements that are the same and function the same are identified substantially by the same reference numerals as in FIGS. 1–4. FIG. 6 shows a section taken along the line VI—VI of FIG. 5. The perforated disk 42 and the intermediate disk 70 are shown in FIG. 5 in a section taken along the line V—V of FIG. 6.

An end section 68 of the valve needle 15 cooperating with the conical valve seat face 20 is embodied spherically, for example, and effects the opening and closing of the fuel injection valve. The flow conduit 19 ends immediately at the downstream end of the conical valve seat face 20, for example, in the flow opening 39 at the face end 40 of the nozzle body 5.

A flat intermediate disk 70 is disposed with its upper face 71 approximately coaxially with the face end 40 of the nozzle body 5, and it is firmly joined to the nozzle body 5, for instance by laser welding. By way of example, the intermediate disk 70 has four circular through openings 72. The four through openings 72 communicate with the flow opening 39 of the flow conduit 19, and for example all have the same diameter, and as can be seen from FIG. 6 are for instance all embodied on the same hole circle diameter 75. The through openings 72 of the intermediate disk 70 may also have a cross section that departs from the circular shape, for example an oval, rectangular or similar cross section. Moreover, the intermediate disk 70 may have only a single flow opening 72, which has approximately the cross-sectional shapes and sizes of the flow openings 39, as has been described for the exemplary embodiments of FIGS. 3 and 4 and shown in dot-dashed lines in FIG. 6, for example.

The flat perforated disk 42 rests with its first face 51 on a face end 74 of the intermediate disk 70 remote from the nozzle body 5. The perforated disk 42 has four circular metering openings 43, for example. All four metering openings 43 are for example formed on the same hole circle diameter 45 and for example have the same diameter. The through openings 72 of the intermediate disk 70 and the metering openings 43 of the perforated disk 42 are not covered in the radial direction by the flow opening 39 of the flow conduit 19, because both the hole circle diameter 45 of the perforated disk 42 and the hole circle diameter 75 of the intermediate disk 70 are smaller, by at least half the diameter of the metering openings 43 or through openings 72, as applicable, than the diameter of the flow opening 39, which for instance has a circular cross section. The flow opening 72 or flow openings 72 of the intermediate disk 70 at least partially covers the metering openings 43 of the perforated disk 42, forming free flow cross sections 46 at the metering openings 43 in the region of the coverage, so that the fuel, when the fuel injection valve is opened, flows along the valve seat face 20 through the flow opening 39, the through opening 72 or through openings 72, and the adjoining metering openings 43, to reach the preparation bore 60 of the preparation sleeve 50.

To reduce production costs and to simplify assembly, it is practical if the perforated disk 42 and the intermediate disk 70 are embodied completely identically, or in other words if the metering openings 43 and the through openings 72 are located on the same hole circle diameter 45, 75, are spaced apart by the same distance from one another, and have the same circular shape and the same diameter.

The perforated disk 42 is pressed against the intermediate disk 70, the latter being firmly joined to the nozzle body 5, in that the bottom 52 of the coaxial blind bore 53 of the preparation sleeve 50 engages the perforated disk 42 in an outer region, at its second face 54 remote from the intermediate disk 70. The centering of the perforated disk 42 between the bottom 52 of the preparation sleeve 50 and the intermediate disk 70 is attained by means of a centering shoulder 76, of circular shape, for example, embodied in the stepped blind bore 53. The centering shoulder 76 at least partially radially surrounds the circular circumference of the perforated disk 42 without play, so that the perforated disk 42 can be rotated only relative to the valve housing 1 or to the intermediate plate 70 joined to the nozzle body 5. The perforated disk 42 is clamped between the intermediate disk 70 and the preparation sleeve 50, for instance in that the preparation sleeve 50 is screwed by its internal thread 58 onto the external thread 59 formed on the circumference of the nozzle body 5. Concentrically with the longitudinal valve axis 16, the preparation bore 60 begins at the bottom 52 of the preparation sleeve 50 and ends at the face end 61 of the preparation sleeve 50 remote from the internal thread 58.

If the fuel quantity output during the steady opening state by the completely assembled, opened fuel injection valve, measured in a first method step according to the invention, does not match the specified set-point quantity, then in a second method step according to the invention, the perforated disk 42 and the valve housing 1 or nozzle holder 5 having the intermediate disk 70 are rotated relative to one another. As a result, the free flow cross sections 46 of the various metering openings 43, and thus the fuel quantity output, are varied. The size of the free flow cross sections 46 of the metering openings 43 depends on the degree of coverage of the metering openings 43 of the perforated disk 42 by the flow opening 72 or flow openings 72 of the intermediate disk 70. If the actual quantity of fuel output matches the specified set-point quantity, then in this position, in a third method step according to the invention, the perforated disk 42 is fixed relative to the intermediate disk 70 or nozzle holder 5 or to the valve housing 1.

The longitudinal axes 44, 73 of the metering openings 43 or flow openings 72 may extend in the same direction as the longitudinal valve axis 16, but it is also possible for the longitudinal axes 44 of the metering openings 43 and/or the longitudinal axes 73 of the through openings 72 extend on an incline to the longitudinal valve axis 16.

The partial coverage of the metering openings 43 by the face end 40 of the nozzle body 5 or by the face end 74 of the intermediate disk 70 also leads to an improvement in the atomization of the fuel.

The perforated disk 42 and/or the intermediate disk 70 may be made from a monocrystalline silicon, and the metering openings 43 or through openings 72 may be formed by isotropic or anisotropic etching. This makes it possible to achieve especially sharp edges of the metering openings 43 and through openings 72, which effect good fuel atomization.

The method according to the invention has the advantage that in an otherwise completely assembled fuel injection valve, the static fuel quantity injected during the steady opening state can be adjusted directly. As a result, not only is the deviation in the static fuel quantity of the various fuel injection valves minimized, but a reduction in production costs are simultaneously attained as well.

The foregoing relates to preferred exemplary embodiments of the invention, it being understood that other variants and embodiments thereof are possible within the spirit and scope of the invention, the latter being defined by the appended claims.

We claim:

1. A fuel injection valve comprising a valve housing (1), a valve closing part cooperating with a valve seat face located in a flow conduit (19), and a first perforated disk (42) disposed downstream of the valve seat face, said first perforated disk including at least two metering openings (43); said first perforated disk (42) adapted to abut a face end (40) that partially covers the metering openings (43), the face end (40) and the first perforated disk (42) are movable relative to one another, for adjustably varying the cross sections (46) of the various metering openings (43), and thereafter locked in a set position, and said face end (40) is a part of a nozzle body (5) and is interrupted by a non-circular flow opening (39) of the flow conduit (19).

2. A fuel injection valve as defined by claim 1, in which the face end (40) and the first perforated disk (42) are rotatable relative to one another.

3. A fuel injection valve as defined by claim 2, which includes a second perforated disk disposed between said face end (40) and said first perforated disk said second perforated disk (70) includes at least one through opening (72) disposed in an axial direction between a flow opening (30) and the first perforated disk (42), the first perforated disk (42) being adapted to abut a face end (74) of said second perforated disk, so that the at least one through opening (72) partially covers the metering openings (43) in said first perforated disk (42), and said first perforated disk and the second perforated disk are relatively rotatable, for varying a free flow cross sections (46) of the metering openings (43), relative to said at least one through opening and said first and second perforated disks are flexible in a prearranged position.

4. A fuel injection valve as defined by claim 3, in which the second perforated disk comprises the same number of through openings as the first perforated disk has metering openings and further that the metering openings (43) of the first perforated disk (42) and the through openings (72) of the second perforated disk (70) are circular, comprise the same diameter, and are located on a same hole circle diameter 45, 75).

5. A fuel injection valve as defined by claim 3, in which each of said first perforated disks comprise a monocrystalline silicon.

6. A fuel injection valve as defined in claim 2, in which said first perforated disk comprises a monocrystalline silicon.

7. A fuel injection valve as defined in claim 1, in which the flow opening (39) of the flow conduit (19) comprises a cross section in the form of an oblong slot.

8. A fuel injection valve as defined in claim 7, in which said first perforated disk comprises a monocrystalline silicon.

9. A fuel injection valve as defined by claim 1, in which the flow opening (39) of the flow conduit (19) comprises a rosette-like cross section.

10. A fuel injection valve as defined in claim 9, in which said first perforated disk comprises a monocrystalline silicon.

11. A fuel injection valve as defined by claim 1, which includes a second perforated disk disposed between said face end (40) and said first perforated disk said second perforated disk (70) includes at least one through opening (72) disposed in an axial direction between a flow opening (39) and the second first perforated disk (42), the first perforated disk (42) being adapted to abut a face end (74) of said second perforated disk, so that the at least one through opening (72) partially covers the metering openings (43) in said first perforated disk (42), and said first perforated disk and the second perforated disk are relatively rotatable, for varying a free flow cross sections (46) of the metering openings (43), relative to said at least one through opening and said first second perforated disks are fixable in a pre-arranged position.

12. A fuel injection valve as defined by claim 11, in which the second perforated disk comprises the same number of through openings as the first perforated disk has metering opening and further that the metering openings (43) of the first perforated disk (42) and the through openings (72) of the second perforated disk (70) are circular, comprise the same diameter, and are located on a same hole circle diameter (45, 75).

13. A fuel injection valve as defined by claim 11, in which each of said first perforated disks comprise a monocrystalline silicon.

14. A fuel injection valve as defined in claim 1, in which said at least one through opening (72) in said second perforated disk and said metering openings (43) in said first perforated disk have the same diameters and have centers which are on a circle having a diameter (45), and said disk are held in place by a preparation sleeve (50) threaded onto said nozzle body (5).

15. A fuel injection valve as defined by claim 1, in which said first perforated disk comprises a monocrystalline silicon.

* * * * *